United States Patent [19]

Velasquez

[11] 4,020,521

[45] May 3, 1977

[54] TOOTHBRUSH

[76] Inventor: Robert L. Velasquez, 11422 Minden, Detroit, Mich. 48025

[22] Filed: Apr. 11, 1975

[21] Appl. No.: 567,315

[52] U.S. Cl. ..... 15/172; 15/167 R; 15/176

[51] Int. Cl.[2] ..... A46B 9/04

[58] Field of Search ..... 15/167 R, 167 A, 172, 15/176, 110

[56] References Cited

UNITED STATES PATENTS

| | | | |
|---|---|---|---|
| 1,680,558 | 8/1928 | Loiselle | 15/172 |
| 2,047,613 | 7/1936 | Brown | 15/172 |
| 2,503,134 | 4/1950 | Schroeder | 15/172 |

FOREIGN PATENTS OR APPLICATIONS

| | | | |
|---|---|---|---|
| 818,794 | 5/1952 | Germany | 15/167 R |
| 451,877 | 5/1968 | Switzerland | 15/172 |

*Primary Examiner*—Peter Feldman
*Attorney, Agent, or Firm*—Basile, Weintraub & VanOphem

[57] ABSTRACT

A dental appliance and, in particular a toothbrush, includes a V-shaped bristle configuration formed in a first member. The first member is incrementally rotatably mounted in a second member.

2 Claims, 4 Drawing Figures

TOOTHBRUSH

BACKGROUND OF THE INVENTION

1. Field of the Invention

The present invention pertains to dental hygiene and appliances therefor. More particularly, the present invention pertains to toothbrushes and the like.

2. Prior Art

The problems attendant the proper care and brushing of the teeth have heretofore been reported. Generally, most persons continue to use a horizontal back and forth method, contrary to the recommended vertical up and down method. While the back and forth method is somewhat effective in cleaning the mating portions of the crown surfaces of the teeth, it is considerably less effective in cleaning the sides of the teeth.

More disconcerting, yet, is the danger of abrasions and infections of gingival areas of the teeth caused by penetration and contact of the toothbrush bristles when the back and forth method is used. This danger is alleviated by the use of the up and down method. However, because of inherent human frailties, the up and down method is not entirely efficacious. Not all persons are ambidextrous and, therefore, right-handed persons have a tendency to more effectively brush the left side of the mouth because of the linear nature of a conventional toothbrush. Conversely, left handed persons brush the right side of the mouth more effectively because of the same limitations.

Coupled with the inherent human problem is the deficiencies in toothbrushes, per se. Most toothbrushes are linear members having projecting rows of individual or rows of tufts of bristles extending therefrom. The bristles are normally of equal length. This construction has two inherent defects. First, it is virtually impossible to simultaneously brush the crown surface of a tooth while massaging the gum, without undue irritation to the gum. Secondly, the position of the bristles is non-adjustable thereby making it impossible to accommodate effective brushing of the entire mouth by a left-handed or right-handed person. The prior art has heretofore recognized these problems.

Thus, the prior art has provided toothbrushes intended to alleviate these problems. For example, U.S. Pat. No. 3,474,481 teaches a toothbrush configuration which facilitates the brushing of the rearward or lingual surfaces of the teeth. While being effective for brushing of the upper teeth, the handle configuration renders brushing of the lingual surfaces of the lower teeth cumbersome. U.S. Pat. No. 3,398,421 teaches a toothbrush having rotatable bristles. However, the construction thereof is complex in that retaining walls and the like must be utilized. Finally, in the U.S. Pat. No. 3,678,528 teaches a toothbrush having a medial groove intended to improve the contact of the bristles and the gums and teeth as well as buccal and lingual surfaces and the interdigital area. Yet, the left or right-handed user problem persists with this latter brush.

On the other hand, the present invention provides a toothbrush which alleviates the left- or right-handed user problem and, concommitantly, employs an effective bristle configuration.

SUMMARY OF THE INVENTION

The present invention provides a dental appliance and, in particular, a toothbrush comprising a first or bristle-carrying member and a second member or handle. The bristle-carrying member is adapted to be incrementally rotatably mounted on the handle.

The first member further includes a plurality of bristles projecting outwardly from a first side thereof. The bristles are provided with a V-shaped configuration. A second side of the member has a depending projection having a serrated or like periphery.

The second member comprises an elongated handle having an aperture for receiving the projection of the first member. The interior surface of the aperture is complementary configured to that of the projection. Thus, the first member is incrementally rotatably mounted in the aperture.

For a more complete understanding of the present invention reference is made to the following detailed description and accompanying drawing. In the drawing like reference characters refer to like parts throughout the several views, in which:

DESCRIPTION OF THE PREFERRED EMBODIMENTS

Figure 1:
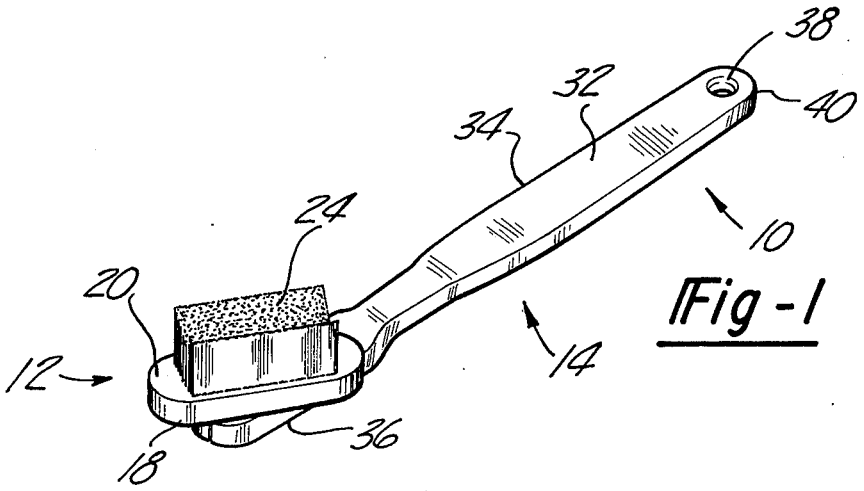
FIG. 1 is a perspective view of the toothbrush of the present invention with the bristle-carrying member in a rotated position.

Now with reference to the drawing there is depicted therein a dental appliance or toothbrush, generally denoted at 10, in accordance with the present invention. The toothbrush 10 generally comprises a first or bristle-carrying member 12 and a second member or handle 14. The toothbrush 10, also, comprises means, generally indicated at 16, for incrementally rotating the first member 12 about the longitudinal axis of the handle 14.

With more specificity, the first member 12 comprises a base or support 18. The base 18 includes a first surface 20 and a second or opposite surface 22. Projecting outwardly from the first surface and substantially perpendicular thereto are a plurality of bristles 24. The bristles 24 are for brushing the teeth. At the outset, it should be noted that in the drawing, the bristles are depicted as a plurality of individual bristles which are spaced apart and aligned into a plurality of rows. However, it is to be understood that the bristles could be arranged in a plurality of tufts or bristles which are aligned in rows. Thus, the present invention effectively utilizes any conventional bristle arrangement.

Referring again to the drawing, the bristles 24 are severed or cut to form a symmetrical V-shape 26, the apex of which is substantially mid-way between the bristles 24, as shown. It has been found that by forming the bristles in the shape of a V, more effective brushing of the teeth and gums or gingiva is achieved. While the shorter bristles contact the tooth surface, the longer bristles massage the gingiva. The longest bristles contacting the gums during the up and down stroke. The same is true with respect to the use of a back and forth stroke since the bristles flex upon contact with the teeth, thereby, causing the longer bristles to contact the gums.

The bristles 24 can be formed from any suitable material including nylon, natural bristles and the like. The only criticality attached to the bristles is that they be provided with a V-shaped configuration.

In forming the V-shape, it is preferred that the apex of the V be positioned centrally of the rows of bristles and extend from the surface 20 a length equal to about one-half the length of the longest or outwardmost bristles.

Figure 2:
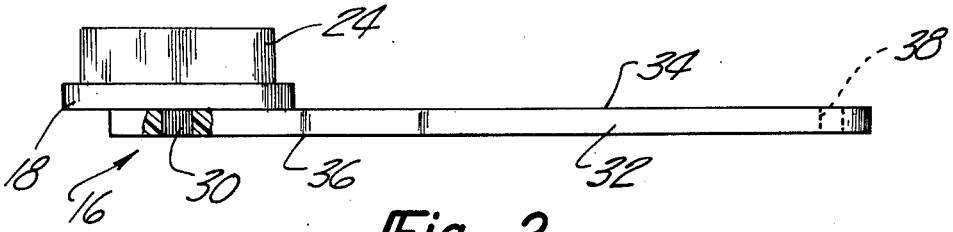
FIG. 2 is a side elevational view, partly in cross-section, of the toothbrush of the present invention.

Referring again to the drawing, the first member 12, also, includes a projection 28 which depends from the second or opposite surface 22. The projection 28 is, preferably, integrally formed with the support 18. The projection has a length equal to that of the height of the handle 14, as clearly shown in FIGS. 2 and 3. The circumference or periphery of the projection 28 includes a plurality of serrations 30 provided therearound. As will subsequently be detailed, the serrations 28 limit the rotatability of the first member 12.

The handle 14 comprises an elongate unitary member 32 having a hand-holding portion or section 34 and a first member carrying section 36. The hand-holding section may include an aperture 38, formed therethrough which retains a conventional rubber gum massage device or the like. The aperture, if present, is conveniently located at the end 40 of the elongate member 32.

Figure 3:
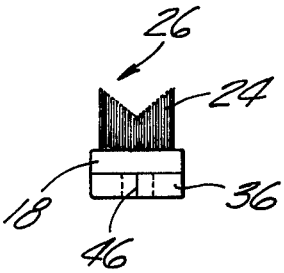
FIG. 3 is an end elevational view of the toothbrush hereof.
Figure 4:
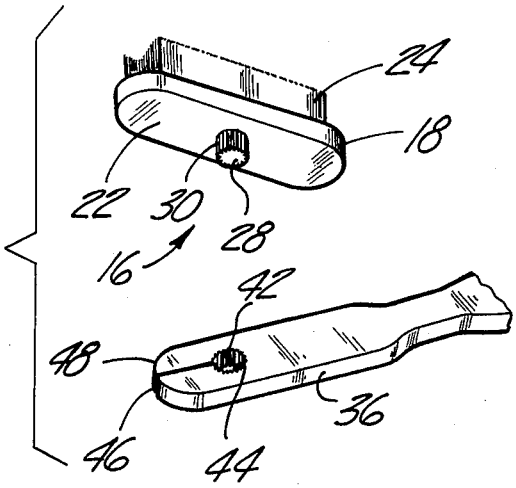
FIG. 4 is an exploded, partially broken, perspective view of the toothbrush hereof.

The first member-carrying section 36 has a width equal to that of the first member 12 such that when the horizontal axes of the two members are aligned, the first member 12 is contiguous to the second member (FIG. 3). The section 36 is provided with a centrally located aperture 42. The aperture 42 extends completely through the handle 14. The periphery or circumference of the aperture 42 is provided with a plurality of serrations 44 which are formed completely therearound.

The serrations 44 are complementary to the serrations 30 formed on the projection 28, such that interlocking therebetween can be achieved in the known manner.

It is to be appreciated that the serrated projection 28 is insertable into the serrated aperture 42 and, thus, cooperate to define the means 16 for incrementally rotating the first member 12 about its vertical axis. These serrations 30 and 42 include edges that are straight and paralled to each other for the entire length of said projection 28 and the full depth of said aperture 42. Futhermore, it is to be appreciated that the complementary serrations cooperate to limit the rotation to increments while, contemporaneously, fixing or locking the first member in any selected set position.

In order to further negate any free rotatability of the first member 12, it is preferred that the projection 28 have a diameter slightly larger than that of the aperture 42. Thus, the aperture will tightly and snugly receive the projection. In order to permit insertion of the projection into the aperture and the rotation thereof, the section 36 is provided with a slit 46. The slit 46 extends from the end 48 of the section 36 to the aperture 42. The slit is in a plane that is perpendicular to the handle 34. The slit 46 provides the stress relief necessary to permit the insertion of the projection and the rotation of the first member, while contemporaneously, maintaining the rigidity of the handle.

In forming the instant toothbrush, the members thereof can be manufactured from any suitable material including synthetic resinous materials, such as, rigid polypropylene, synthetic rubbers and the like.

Furthermore, it is to be understood that the complimentary configuration of the projection and aperture need not be limited to serrations. Any mode of limiting the degree of rotation in the manner heretofore described can be effectively utilized herein.

Also, and with respect to the rotatability of the first member, it is apparent that this permits adjusting the position of the bristles to effectively reach all the surfaces of all the teeth, whether the user be left-handed or right-handed.

Having, thus, described the invention what is claimed is:

1. A toothbrush, comprising:

a. a first member comprising:

1. a support having opposite first and second surfaces, 2. a projection depending from the second surface and having a plurality of serrations formed therearound, b. a plurality of bristles projecting outwardly from and substantially perpendicular to the first surface of the first member, the bristles being configured in the shape of a V, c. an elongate second member having an aperture formed therethrough proximate a first end thereof, the aperture having a plurality of serrations formed therearound, the serrations being complementarily configured to the projection, the aperture receiving the projection to retain the first member, the second member having a slit in a plane perpendicular to said second member and extending from the first end to the aperture, wherein the complementary serrations define means for incrementally rotating the first member about the vertical axis of the second member, the projection having a height equal to the depth of the aperture such that the terminus of the projections is coplanar with the surface of the second member, d. said serations of said projection and said serations of said aperture having edges that are straight and parallel with respect to each other for the entire length of the projection and the full depth of the aperture, and e. the projection having a diameter slightly larger that that of the aperture.

2. The toothbrush of claim 1 wherein the support member has a width equal to that of the second member.

* * * * *